US006526941B1

(12) United States Patent
McDonald et al.

(10) Patent No.: US 6,526,941 B1
(45) Date of Patent: Mar. 4, 2003

(54) DYNAMIC ELECTRONIC THROTTLE POSITION FEEDFORWARD SYSTEM

(75) Inventors: Dennis McDonald, Canton, MI (US); Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/930,428

(22) Filed: Aug. 14, 2001

(51) Int. Cl.[7] ..... F02D 1/00
(52) U.S. Cl. ..... 123/399; 123/361
(58) Field of Search ..... 123/361, 399; 318/254

(56) References Cited

U.S. PATENT DOCUMENTS 4,213,304 A * 7/1980 Morse ..... 60/664
4,258,424 A * 3/1981 Giras et al. ..... 60/660
4,492,195 A * 1/1985 Takahashi et al. ..... 123/339.11
4,696,167 A * 9/1987 Matsui et al. ..... 62/180
5,992,384 A * 11/1999 Bauer et al. ..... 123/350
6,263,856 B1 * 7/2001 Weber et al. ..... 123/352
6,302,084 B1 * 10/2001 Kamimura et al. ..... 123/361
6,397,816 B1 * 6/2002 Pursifull ..... 123/361

* cited by examiner

*Primary Examiner*—John Kwon
(74) *Attorney, Agent, or Firm*—John E. Kajander

(57) ABSTRACT

A method for controlling a positioning device of an internal combustion engine includes the steps of: providing an electric motor for actuating the positioning device with the positioning device applying a torque to the; detecting a commanded position of the positioning device; detecting a sensed position of the positioning device; forming a damping term based upon the sensed position; forming a dynamic feedforward term based upon the commanded position; and forming a control action based separately upon the damping term and the dynamic feedforward term.

8 Claims, 2 Drawing Sheets

DYNAMIC ELECTRONIC THROTTLE POSITION FEEDFORWARD SYSTEM

TECHNICAL FIELD

The present invention relates generally to control systems for internal combustion engines, and more particularly, to a dynamic electronic throttle position feedforward system.

BACKGROUND ART

Many previously known motor vehicle throttle controls have a direct physical linkage between an accelerator pedal and the throttle body so that the throttle plate is pulled open by the accelerator cable as the driver presses the pedal. The direct mechanical linkage includes biasing that defaults the linkage to a reduced operating position also known as idle, in a manner consistent with regulations. Nevertheless, such mechanisms are often simple and unable to adapt fuel efficiency or minimizing regulated emissions or enhancing driveability to changing traveling conditions, and add significant weight and components to the motor vehicle.

An alternative control for improving throttle control and the efficient introduction of fuel air mixtures into the engine cylinders is presented by electronic throttle controls. The electronic throttle control includes a throttle control unit that positions the throttle plate by an actuator controlled by a microprocessor based on sensor input. The processors are often included as part of a powertrain electronic control that can adjust the fuel and air intake and ignition in response to changing conditions of vehicle operation as well as operator control. Protection may be provided so that an electronic system does not misread or misdirect the control and so that unintended operation is avoided when portions of the electronic control suffer a failure.

The throttle control unit that positions the throttle plate must accelerate and decelerate a mass with torque such that a given position is attained. Traditional proportional integral derivative (PID) control of throttle plate position determines control action based upon a single gain on the derivative term of throttle position error. Throttle position error is determined from the difference between the throttle position command and the throttle position sensed. This has a double effect. While the derivative term of traditional PID control opposes fast throttle motion, it gives an added torque boost during a throttle positions command change. Normally, this would be acceptable. Instead of using throttle position error, however, benefit may be gained from handling the throttle position command and the throttle position sensed, separately.

The disadvantages associated with these conventional proportional integral derivative control techniques have made it apparent that a new technique using a dynamic feedforward term for throttle plate positioning is needed. The new technique should provide improved performance over traditional proportional integral derivative control. The present invention is directed to these ends.

SUMMARY OF THE INVENTION

It is, therefore, an object of the invention to provide an improved and reliable dynamic electronic throttle position feedforward system. Another object of the invention is to improve performance by handling the throttle position command and the throttle position sensed signals separately.

In accordance with the objects of this invention, a dynamic electronic throttle position feedforward system is provided. In one embodiment of the invention, a method for controlling a positioning device of an internal combustion engine includes the steps of: providing an electric motor for actuating the positioning device with the positioning device applying a torque to the; detecting a commanded position of the positioning device; detecting a sensed position of the positioning device; forming a damping term based upon the sensed position; forming a dynamic feedforward term based upon the commanded position; and forming a control action based separately upon the damping term and the dynamic feedforward term.

The present invention thus achieves an improved dynamic electronic throttle position feedforward system. The present invention is advantageous in that the performance is improved over a feedforward system based on throttle position error.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
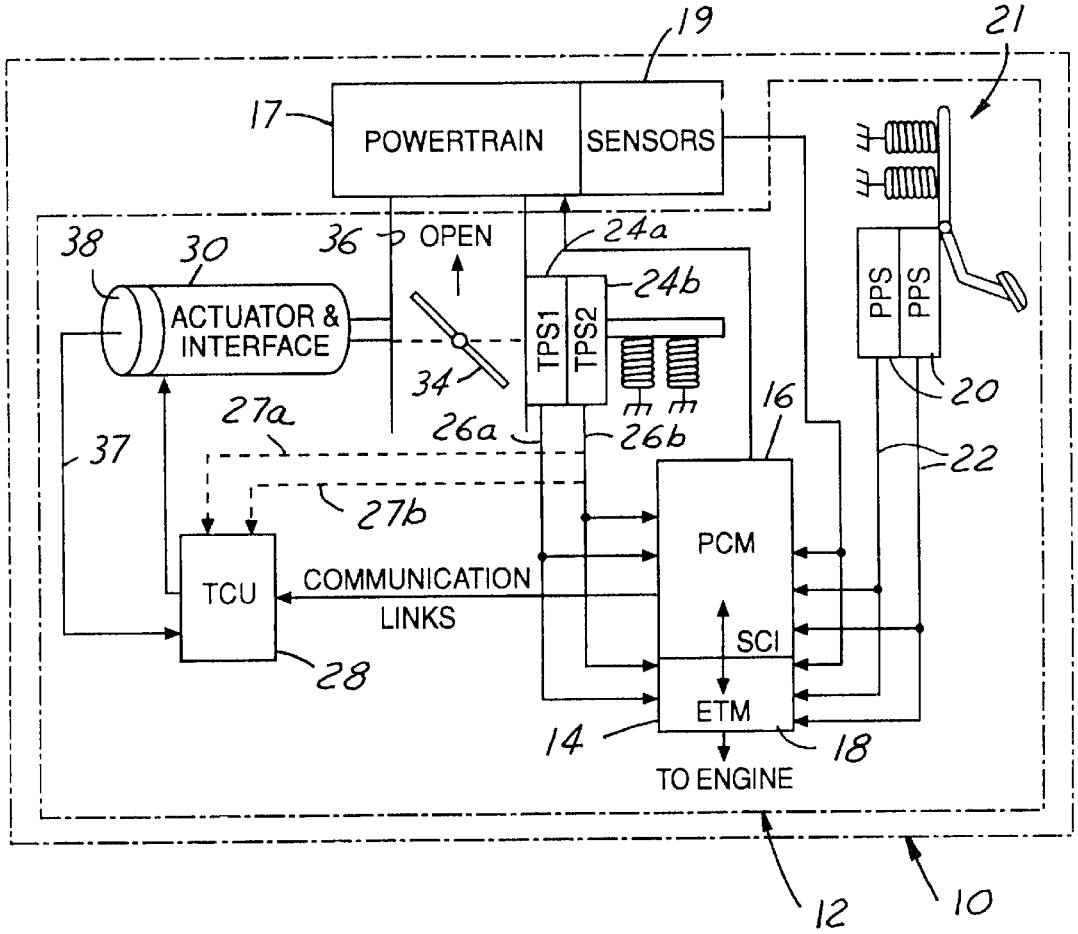
FIG. 1 is a block diagram of an electronic throttle system in accordance with one embodiment of the present invention.

In the following figures, the same reference numerals will be used to identify identical components in the various views. The present invention is illustrated with respect to a dynamic electronic throttle position feedforward system, particularly suited for the automotive field. However, the present invention is applicable to various other uses that may require dynamic electronic throttle position feedforward systems.

Referring to FIG. 1, a motor vehicle powertrain system 10 including electronic throttle control system 12 includes an electronic control unit 14. In the preferred embodiment, the electronic control unit 14 includes a powertrain control module (PCM) 16 including a main processor and an electronic throttle monitor (ETM) 18 including an independent processor. The PCM and ETM share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for independent processing.

A wide variety of inputs are represented in the FIG. 1 diagram by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

The throttle control unit that positions the throttle plate must accelerate and decelerate a mass with torque such that a given position is attained. When the position control is acting against a known biasing torque of force, that force may be compensated for with a feedforward term. In this way, the integral control does less work and positioning performance is improved. While prior art applies this concept to a controller for a motorized throttle by using a feedforward term based on actual position also known as position feedback, the present invention uses a feedforward term based on commanded position.

Figure 2:
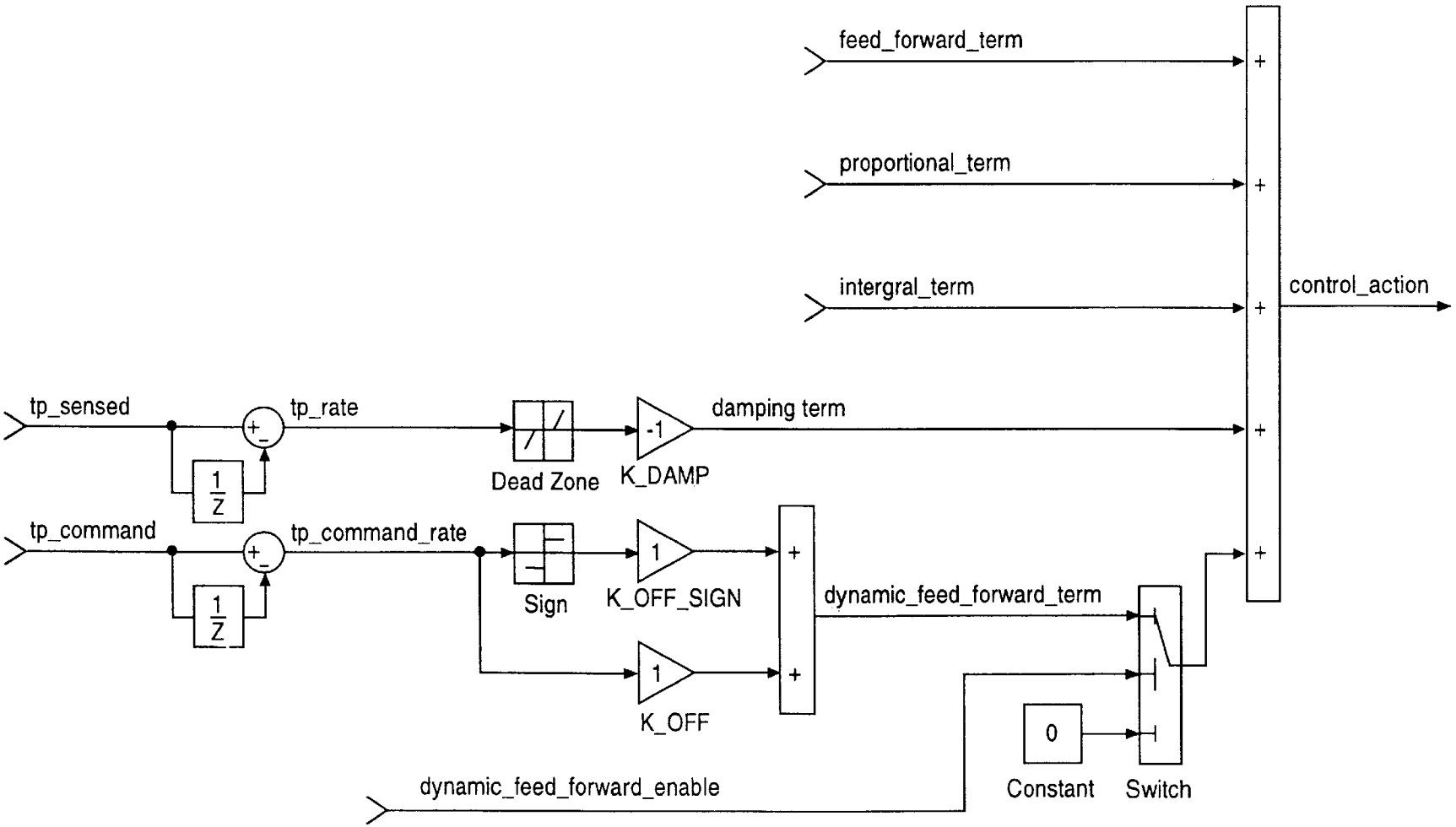
FIG. 2 is a block diagram of a dynamic electronic throttle position feedforward system in accordance with one embodiment of the present invention.

Referring to FIG. 2, a block diagram of a dynamic electronic throttle position feedforward system in accordance with one embodiment of the present invention is illustrated. The present invention improves over the prior art by handling sensed throttle position and desired throttle position separately instead of simply determining a derivative term based on a difference between the two, known as position error. Throttle position minus throttle position previous (unit delay) is throttle position rate. Desired throttle position is also subjected to a unit delay to produce a desired throttle position rate.

The noisy sensed throttle position rate signal is filtered through a dead zone and multiplied by a gain to produce a damping term. This allows for excellent damping characteristics without an increase in positional noise due to the system feeding on its own noise.

A dynamic feed forward term (not to be confused with a static feed forward term, which is a function of the present throttle position command alone) is formed from the throttle position command rate. The dynamic feed forward term is determined by using a throttle position rate command multiplied by a gain combined with a throttle position rate command multiplied by a gain subjected to a sign function. The resulting term has the ability to give a torque boost to the element being positioned to give crisp fine motion control. Small requested motion results in smaller boosts than bigger requested motion. For example, a one unit throttle position command change might result in a 2.5 volt dynamic feed forward term, while a 2 unit throttle position command change might result in a 3.0 volt dynamic feed forward term. This would not be possible if the throttle position command and the throttle position sensed signals were summed together as is done in the prior art.

As described, the present invention works well for step commands reasonably separated in time. In the present invention, the throttle position command is updated approximately every fifty milliseconds, but the control loop runs every two milliseconds. In an alternative implementation, where the throttle position is updated near the control rate, the present invention enables the dynamic feed forward term for the first encountered step change and then disables it after the step input command change. The system in enabled whenever a large step is encountered (over 0.75 degrees) or if no step input changed occurs for sixteen milliseconds or if the requested step input changes sign.

The present invention thus achieves an improved and reliable dynamic electronic throttle position feedforward system by handling the throttle position command and the throttle position sensed signals separately.

From the foregoing, it can be seen that there has been brought to the art a new and improved dynamic electronic throttle position feedforward system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A method for controlling a positioning device of an internal combustion engine, the method comprising the steps of:

detecting a commanded position of said positioning, device;

detecting a sensed position of said positioning device;

forming a dynamic feedforward term based upon said commanded position; and forming a control action based upon said dynamic feedforward term.

2. The method as recited in claim 1, further comprising the step of enabling said dynamic feedforward term for a first encountered step change in throttle position command.

3. The method as recited in claim 2, further comprising the step of disabling said dynamic feedforward term after said step change in throttle position command.

4. The method as recited in claim 3, further comprising the step of re-enabling said dynamic feedforward term for a large step.

5. The method as recited in claim 4, wherein said large step comprises a step larger than 0.75 degrees.

6. The method as recited in claim 4, further comprising the step of re-enabling said dynamic feedforward term when no step input changes for a predetermined period of time.

7. The method as recited in claim 6, said predetermined period of time is approximately sixteen milliseconds.

8. The method as recited in claim 7, further comprising the step of re-enabling said dynamic feedforward term when a requested step input changes sign.

* * * * *

US006526941C1

(12) EX PARTE REEXAMINATION CERTIFICATE (6691st)

United States Patent

McDonald et al.

(10) Number: US 6,526,941 C1

(45) Certificate Issued: Mar. 3, 2009

(54) DYNAMIC ELECTRONIC THROTTLE POSITION FEEDFORWARD SYSTEM

(75) Inventors: Dennis McDonald, Canton, MI (US); Ross Dykstra Pursifull, Dearborn, MI (US)

(73) Assignee: Visteon Corporation, Dearborn, MI (US)

Reexamination Request:
No. 90/006,947, Feb. 24, 2004

Reexamination Certificate for:

| | |
|---|---|
| Patent No.: | **6,526,941** |
| Issued: | **Mar. 4, 2003** |
| Appl. No.: | **09/930,428** |
| Filed: | **Aug. 14, 2001** |

(51) Int. Cl.
*F02D 1/00* (2006.01)

(52) U.S. Cl. ..... 123/399; 123/361

(58) Field of Classification Search ..... 123/399
See application file for complete search history.

(56) References Cited

U.S. PATENT DOCUMENTS

| | | | | | |
|---|---|---|---|---|---|
| 4,498,863 | A | * | 2/1985 | Hanson et al. | 431/89 |
| 5,606,951 | A | * | 3/1997 | Southern et al. | 123/399 |
| 5,852,996 | A | * | 12/1998 | Nakamura et al. | 123/399 |
| 6,390,061 | B1 | * | 5/2002 | Melville et al. | 123/353 |

FOREIGN PATENT DOCUMENTS

| | | | |
|---|---|---|---|
| EP | 0957416 | A | 11/1999 |
| JP | 2000-73830 | A | 3/2000 |

* cited by examiner

*Primary Examiner*—Matthew C. Graham

(57) ABSTRACT

A method for controlling a positioning device of an internal combustion engine includes the steps of: providing an electric motor for actuating the positioning device with the positioning device applying a torque to the; detecting a commanded position of the positioning device; detecting a sensed position of the positioning device; forming a damping term based upon the sensed position; forming a dynamic feedforward term based upon the commanded position; and forming a control action based separately upon the damping term and the dynamic feedforward term.

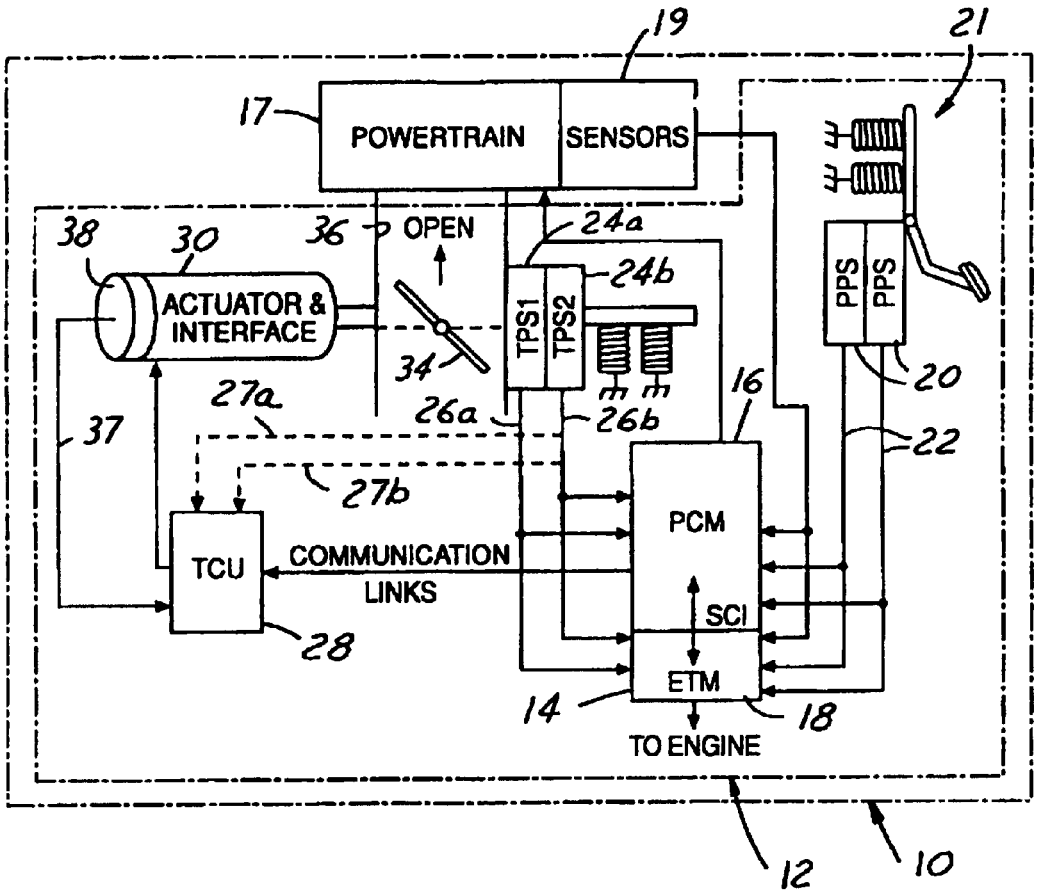

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4 and 6 are cancelled.

Claims 5 and 7 are determined to be patentable as amended.

Claim 8, dependent on an amended claim, is determined to be patentable.

5. [The] *A* method [as recited in claim 4, wherein said large step comprises] *for controlling a positioning device of an internal combustion engine, the method comprising the steps of:*

*detecting a commanded position of said positioning device;*

*detecting a sensed position of said positioning device;*

*forming a dynamic feedforward term based upon said commanded position;*

*forming a control action based upon said dynamic feedforward term;*

*enabling said dynamic feedforward term for a first encountered step change in throttle position command;*

*disabling said dynamic feedforward term after said step change in throttle position command; and*

*re-enabling said dynamic feedforward term for* a step larger than 0.75 degrees.

7. [The ] *A* method [as recited in claim 6.] *for controlling a positioning device of an internal combustion engine, the method comprising the steps of:*

*detecting a commanded position of said positioning device;*

*detecting a sensed position of said positioning device;*

*forming a dynamic feedforward term based upon said commanded position;*

*forming a control action based upon said dynamic feedforward term;*

*enabling said dynamic feedforward term for a first encountered step change in throttle position command;*

*disabling said dynamic feedforward term after step change in throttle position command; and*

*re-enabling said dynamic feedforward term when no step input changes for a predetermined period of time,* said predetermined period of time is approximately sixteen milliseconds.

* * * * *